US007194968B2

(12) United States Patent
Okazaki

(10) Patent No.: US 7,194,968 B2
(45) Date of Patent: Mar. 27, 2007

(54) EMBROIDERY FRAME

(75) Inventor: Yoshiyuki Okazaki, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/350,091

(22) Filed: Feb. 9, 2006

(65) Prior Publication Data

US 2006/0180064 A1 Aug. 17, 2006

(30) Foreign Application Priority Data

Feb. 16, 2005 (JP) ..... 2005-038847

(51) Int. Cl.
*D05C 9/04* (2006.01)
*D05C 9/00* (2006.01)

(52) U.S. Cl. ..... 112/103

(58) Field of Classification Search ..... 112/103, 112/470.14, 117; 38/102.2, 102; 160/380; 297/218.1
See application file for complete search history.

(56) References Cited

U.S. PATENT DOCUMENTS 3,220,469 A * 11/1965 Oehmig ..... 160/380
3,664,288 A * 5/1972 Von Boden et al. ..... 112/103
4,079,529 A * 3/1978 Jennen et al. ..... 38/102.2
5,015,034 A * 5/1991 Kindig et al. ..... 297/227
5,301,737 A * 4/1994 Martin ..... 160/380
5,722,191 A * 3/1998 Morgan ..... 38/102.2
6,378,944 B1 * 4/2002 Weisser ..... 297/440.11

FOREIGN PATENT DOCUMENTS

| | | |
|---|---|---|
| JP | A-57-81369 | 5/1982 |
| JP | Y2-63-27674 | 7/1988 |
| JP | U-03-111589 | 11/1991 |
| JP | Y2-07-54315 | 12/1995 |
| JP | A-08-243280 | 9/1996 |

* cited by examiner

*Primary Examiner*—Ismael Izaguirre
(74) *Attorney, Agent, or Firm*—Oliff & Berridge, PLC

(57) ABSTRACT

An embroidery frame of the present disclosure is provided with an upper frame and a lower frame, both of which clamping a workpiece cloth therebetween, and a clamping unit that presses the upper frame against the lower frame. A projection is formed on an upper surface of the lower frame, wherein a plurality of notched recesses are formed on an outer peripheral surface of the projection. On the other hand a groove capable of being fitted with the projection is formed on a lower surface of the upper frame, wherein a plurality of protrusions capable of being fitted with the notched recesses are formed in the groove.

6 Claims, 7 Drawing Sheets

EMBROIDERY FRAME

CROSS-REFERENCE TO RELATED APPLICATIONS

This application is based upon and claims the benefit of priority from the prior Japanese Patent Application No. 2005-38847, filed on Feb. 16, 2005 the entire contents of which are incorporated herein by reference.

TECHNICAL FIELD

The disclosure relates to an embroidery frame that clamps a workpiece cloth with an upper frame and a lower frame.

BACKGROUND

Conventionally, an embroidery frame has been used that retains an embroidery workpiece cloth in a stretched manner by an outer frame and an inner frame. Such embroidery frame clamps the workpiece cloth between an inner peripheral surface of the outer frame and an outer peripheral surface of the inner frame. Therefore, the problem with such embroidery frame is the formation of creases on the portion clamped by the outer frame and the inner frame when the workpiece cloth is removed from between the outer and inner frames. Also, the outer frame is equipped with a clamping screw for adjusting the size of the outer frame. Therefore, whenever the workpiece cloth is attached to or detached from the embroidery frame, the clamping screw needs to be operated in order to adjust the size of the outer frame, which provides poor workability.

On the other hand, embroidery frames have been suggested in which the workpiece cloth is retained between the upper and lower frames. In such embroidery frames, the workpiece cloth is less prone to creasing, since the workpiece cloth is clamped between the lower surface of the upper frame and the upper surface of the lower frame. However, because the embroidery frame is constructed to simply press the upper frame against the lower frame, sufficient tension cannot be applied to the workpiece cloth clamped between the upper and lower frames. Also, embroidery frames constructed by outer and inner frames have better cloth retainability than embroidery frames constructed by upper and lower frames. Thus, during the sewing process, the workpiece cloth is gradually pulled inward by the thread tension of embroidery patterns, leading to pattern distortion and impairment of sewing quality.

Such being the case, embroidery frames equipped with an auxiliary frame that further downwardly press the workpiece cloth clamped between the upper and lower frames have been reduced to practice. For example, JP-A-8-243280 discloses a workpiece cloth-retaining frame of a clamp type provided with a base frame (lower frame), a first presser frame (upper frame), a second presser frame (auxiliary frame), a first clamp mechanism that presses the upper frame against the lower frame, and a second clamp mechanism that presses the auxiliary frame against the lower frame. The lower frame is provided with a first receiving portion, an elevated portion formed as an elevated stage in the inner peripheral portion of the first receiving portion, and a second receiving portion formed as a lowered stage in the inner peripheral portion of the elevated portion. After fixing the workpiece cloth to the lower frame by pressing the upper frame against the first receiving portion of the lower frame by the first clamp mechanism, when the auxiliary frame is pressed against the second receiving portion of the lower frame by the second clamp mechanism, the auxiliary frame downwardly presses the workpiece cloth in uneven levels in the inner peripheral portion of the upper frame. Thus, the workpiece cloth is retained in a sufficiently stretched state.

However, a clamp mechanism that presses the auxiliary frame to the workpiece cloth is required in addition to the clamp mechanism that presses the upper frame against the lower frame in the above constructed embroidery frame. This leads to an increase in the number of parts, consequently increasing the complexity as well as the weight of the embroidery frame.

SUMMARY

Therefore an object of the present disclosure is to provide an embroidery frame which is capable of securely retaining a workpiece cloth in a sufficiently stretched state between an upper frame and a lower frame and which has a simple and light-weight construction.

The embroidery frame according to the present disclosure is provided with the upper frame, the lower frame clamping the workpiece cloth cooperatively with the upper frame, and a clamp unit that presses the upper frame against the lower frame. The embroidery frame in accordance with the present disclosure is further provided with a projection formed on either one of an upper surface of the lower frame and a lower surface of the upper frame, a plurality of notched recesses formed on the outer peripheral portion of the projection, a groove formed on the other of the upper surface of the lower frame and the lower surface of the upper frame and which is capable of being fitted with the protrusion, and a plurality of protrusions which are formed in the groove and which can be fitted with the notched recess.

According to the present disclosure, the areas of the upper surface of the lower frame and the lower surface of the upper frame serving as cloth clamping surfaces of the lower and upper frames are increased. Consequently, the frictional force between the upper and lower frames and the workpiece cloth clamped therebetween is increased. Thus, the cloth retainability of the upper and lower frames is increased.

Moreover, since the notched recess and the protrusion are formed on the projection and the groove provided on the cloth clamping surfaces of the lower and upper frames, the area of the cloth clamping surface, especially in the outer periphery portion thereof, of the lower and upper frames are increased. Thus, the portion of the workpiece cloth clamped between the lower and upper frames can be restrained from being pulled inward with respect to the lower and upper frames, thereby preventing the loosening of the embroidery forming portion of the workpiece cloth. Also, since the peripheral length of the outer peripheral portion of the upper surface of the lower frame and the lower surface of the upper frame are increased, the shrinking of the workpiece cloth is absorbed by being clamped between the lower and upper frames, rendering the workpiece cloth less prone to creasing.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE INVENTION

Several embodiments applying the present invention to an embroidery frame attached to a sewing machine capable of embroidery sewing will be described hereinafter with reference to the drawings.

Figure 1:
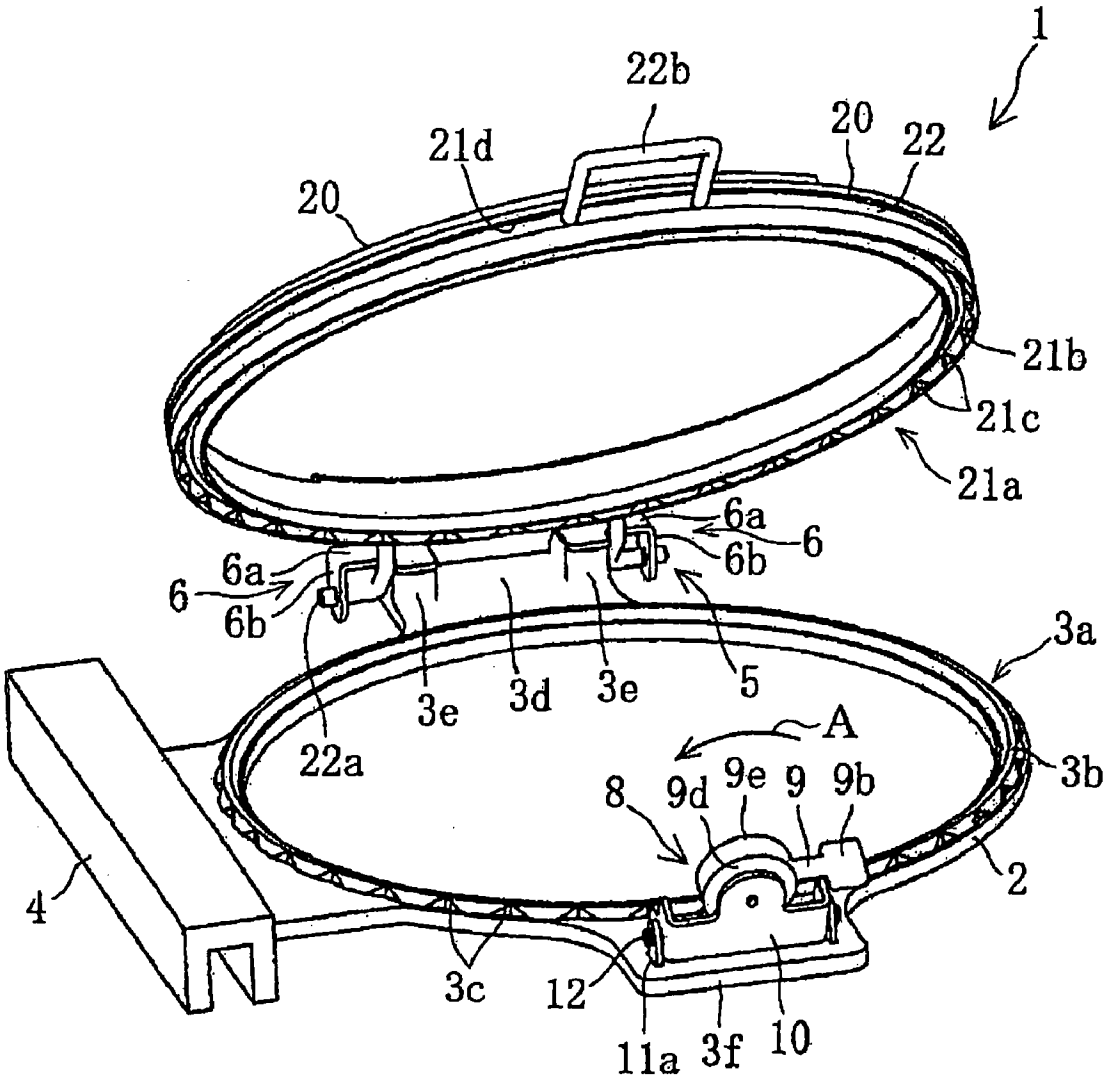
FIG. 1 is a perspective view of an embroidery frame showing an illustrative aspect of the disclosure wherein an upper frame is opened.

FIGS. 1 to 6C illustrate one embodiment of the present invention. As shown in FIG. 1, an embroidery frame 1 is formed in a substantially annular form in plan view and is provided with a lower frame 2 and an upper frame 20. The lower and upper frames 2 and 20 are each made of synthetic resin material.

As shown in FIGS. 1 to 5, a projection 3*b* having a substantially trapezoid cross section is formed on the entire periphery of a cloth clamping surface 3*a* of the lower frame 2. On the outer peripheral surface of the projection 3*b*, more specifically on a sloped surface in the outer peripheral side, a plurality of notched recesses 3*c* are formed at predetermined intervals throughout the entire periphery thereof. A mounting portion 3*f* in a substantially oblong form in plan view is formed in an outwardly protruding manner on the front end of the lower frame 2 and a thick support base 3*d* in a substantially oblong form is formed in an outwardly protruding manner on the rear end of the lower frame 2.

Also, a carriage linkage 4, a hinge connection portion 5 that links the upper frame 20 openably to the lower frame 2, and a clamp mechanism 8 for retaining and pressing the upper frame 20 against the lower frame 2 are provided on the lower frame 2. The carriage linkage 4 is detachably linked to a carriage of the embroidery frame drive mechanism (neither of which are shown) provided in an embroidery unit.

The hinge connection portion 5 is provided on the rear end of the lower frame 2 and is provided with the support base 3*d*, a pair of L-shaped hinge brackets 6, a hinge pin 22*a*, and a screw 7. A pair of bases 3*e* are provided in a protruding manner on the lateral ends of the support base 3*d*. The pair of hinge brackets 6 is respectively fixed on the bases 3*c* by a couple of aforementioned screws 7. The hinge bracket 6 is provided with an upper plate 6*a* and a side plate 6*b* having a pin hole (not shown) formed therein. The hinge pins 22*a* are respectively passed through the pin holes.

The clamp mechanism 8 is provided on the front end of the lower frame 2. The hinge connection portion 5 and the clamp mechanism 8 oppose each other with the center of the lower frame 2 disposed therebetween.

The clamp mechanism 8 is provided with a cam member 9, a support body 10, a mounting plate 11, and a rotary shaft 12. A pair of upwardly protruding support pieces 11*a* is provided on the lateral ends of the mounting plate 11. The mounting plate 11 is inserted into the mounting portion 3*f* from below and is fixed to the mounting portion 3*f* by a screw 14. At this point, the pair of support pieces 11*a* projects from the upper surface of the mounting portion 3*f*. The pair of support pieces 11*a* protrude from the upper surface of the mounting portion 3*f*. A protruding portion 10*a* is formed on the left end of the support body 10. Also, the cam member 9 is rotatably linked to the support body 10 via the rotary shaft 13. The support body 10 is linked to the support pieces 11*a* via the rotary shaft 12.

The cam member 9 is provided with a cam body 9*a* and an operating portion 9*b* integrally provided with the cam body 9*a*. The cam body 9*a* is provided with a cam main body 9*c* and flanges 9*d* and 9*e*. A cam surface (not shown) is formed on the cam main body 9*c*. The height of the lower end of the cam surface is arranged to be lowered (that is, the distance from the rotary shaft 13, which assumes the rotational center of the cam member 9, to the lower end of the cam surface is increased) in accordance with a counterclockwise rotation, as shown by arrow A in FIG. 1, of the operating portion 9*b*.

The flanges 9*d* and 9*e* are provided in the front and rear of the cam body 9*a* respectively. The flange 9*d* in the front side of the cam body 9*a* is formed in a disc form. On the other hand, the rear flange 9*e* is formed in a partially notched disc form so that a later described clamped portion 22*b* can be placed thereon when the upper frame 20 is closed.

The upper frame 20 is provided with a groove 21*b* and a groove 21*d*. Also, the upper frame 20 is provided with a clamped portion 22*b* that is clamped by the clamp mechanism 8 and a retaining member 22.

The groove 21*b* has a substantially trapezoid cross section and is formed on the entire periphery of a cloth clamping surface 21*a* of the lower surface of the upper frame 20. The groove 21*b* is arranged to be fitted with the projection 3*b* of the lower frame 2, and a workpiece cloth 30 (refer to FIG. 6A) is clamped by the groove 21*b* and the projection 3*b*.

On the inner surface of the groove 21*b*, more specifically on the sloped surface of the outer peripheral side, a plurality of protrusions 21*c* are provided at predetermined intervals on the entire periphery thereof. The protrusions 21*c* are arranged to be capable of being fitted with a plurality of notched recesses 3*c* of the lower frame 2.

The groove 21*d* is formed entirely on the outer periphery of the upper frame 20. The retaining member 22 made of metallic wire material in a substantially annular form is attached on the groove 21*d*. The hinge pins 22*a* of the hinge connection portion 5 are respectively formed integrally on the rear end portion (base end portion) of the retaining member 22. Also, a U-shaped clamped portion 22*b* is formed in a curvature on the front end (fore-end) of the retaining member 22.

Figure 2:
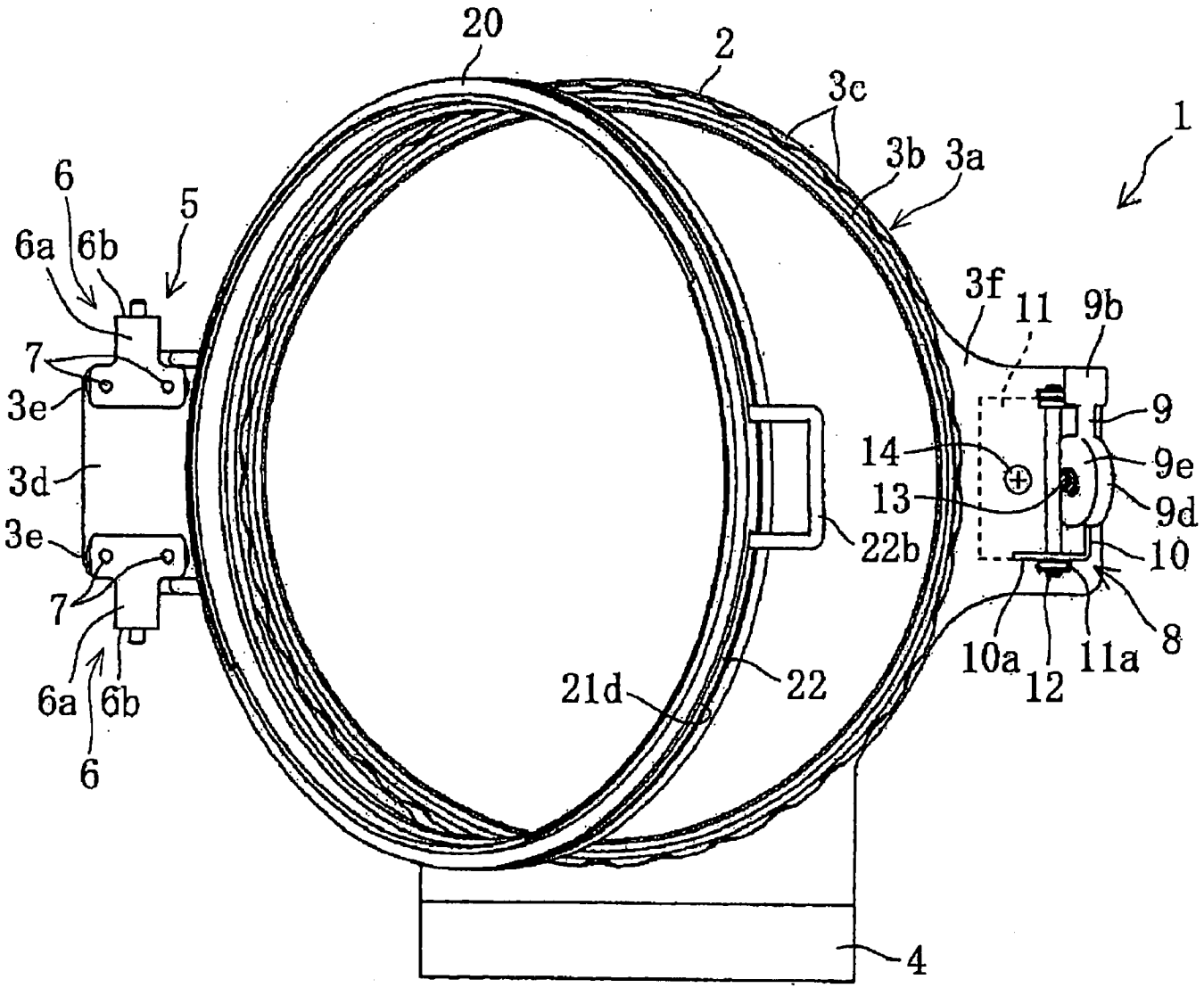
FIG. 2 is a plan view of the embroidery frame wherein the upper frame is opened.
Figure 3:
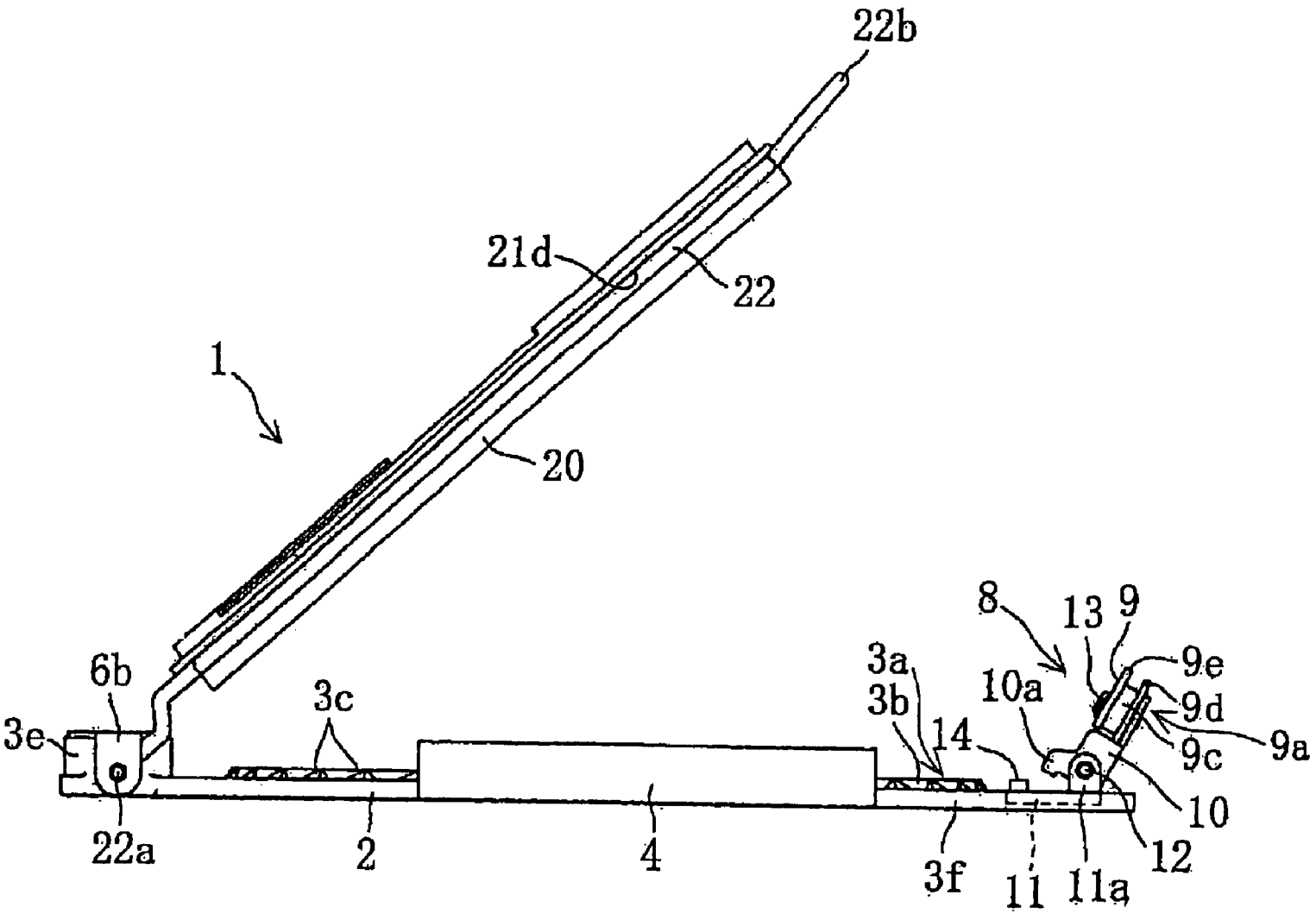
FIG. 3 is a left side view of the embroidery frame wherein the upper frame is opened.
Figure 4:
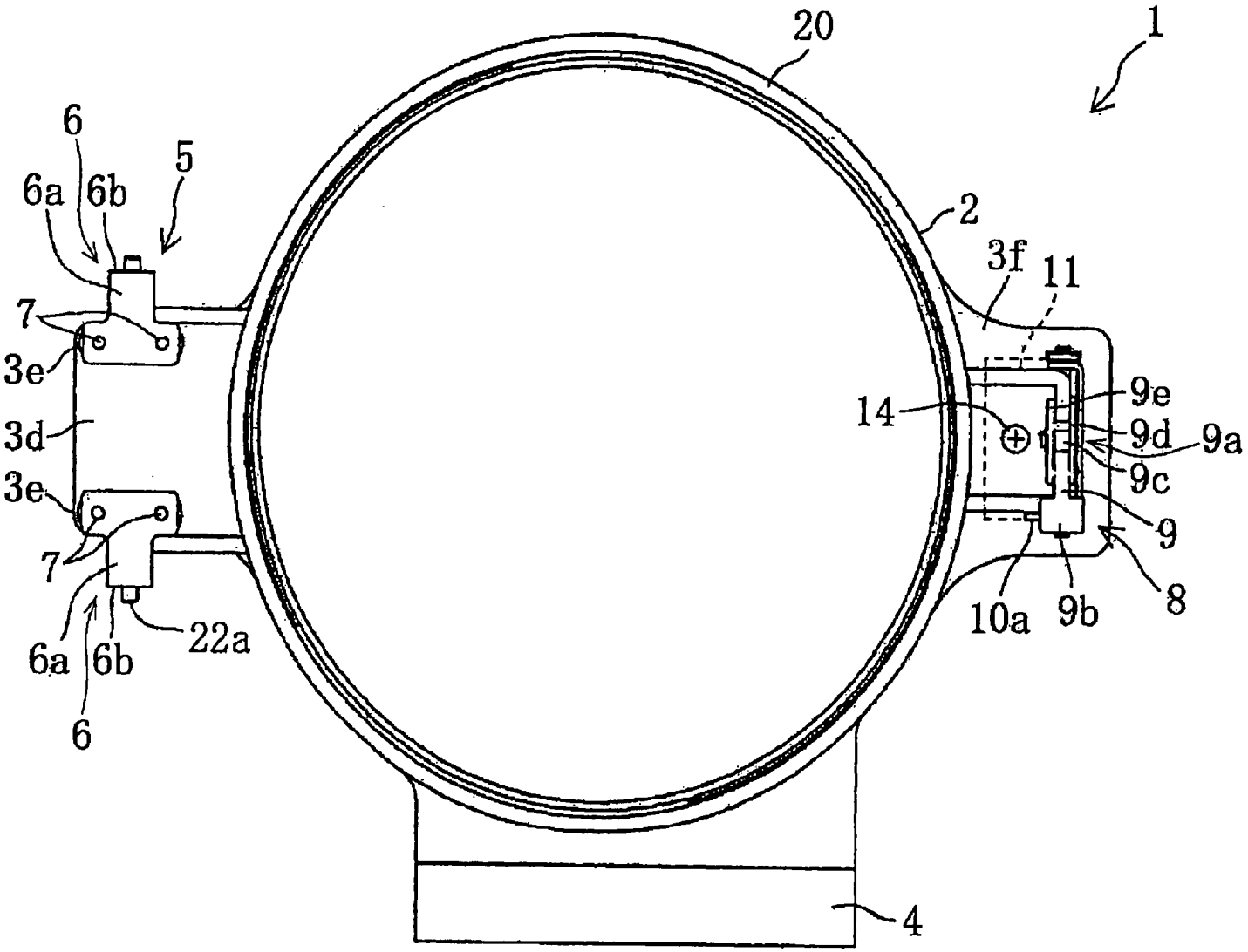
FIG. 4 is a plan view of the embroidery frame wherein the upper frame is closed.
Figure 5:
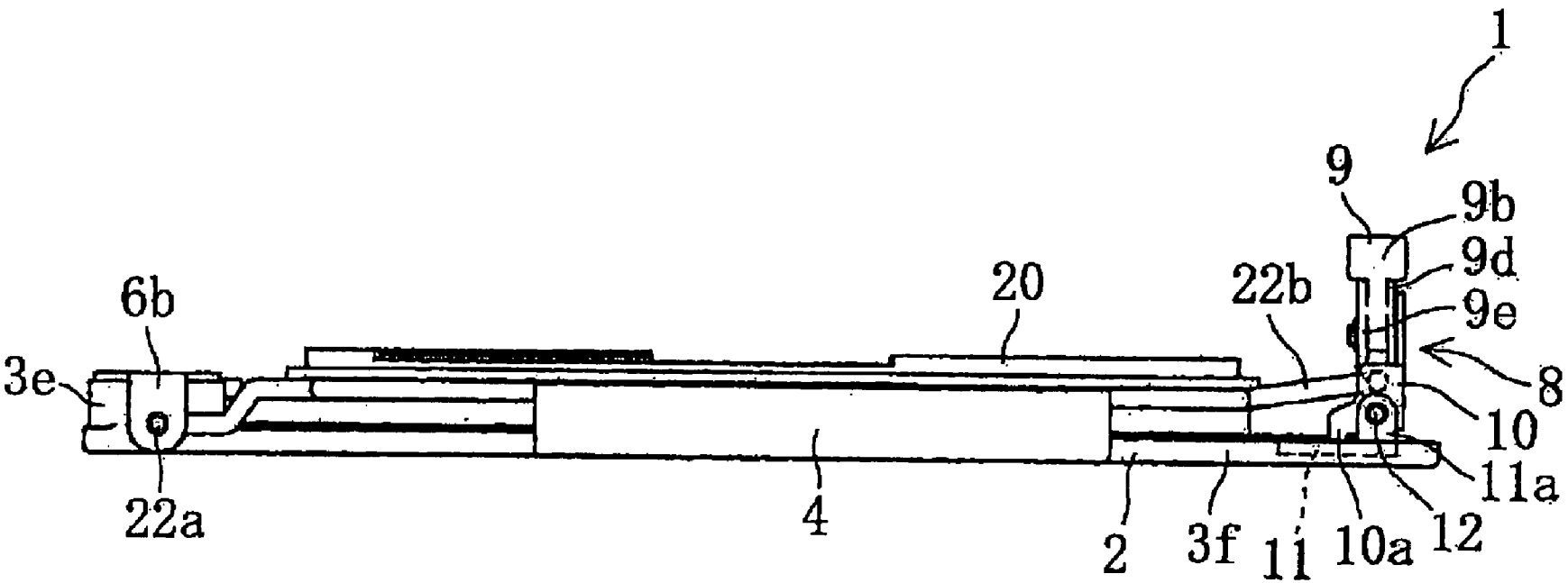
FIG. 5 is a left side view of the embroidery frame wherein the upper frame is closed.
Figure 6A:
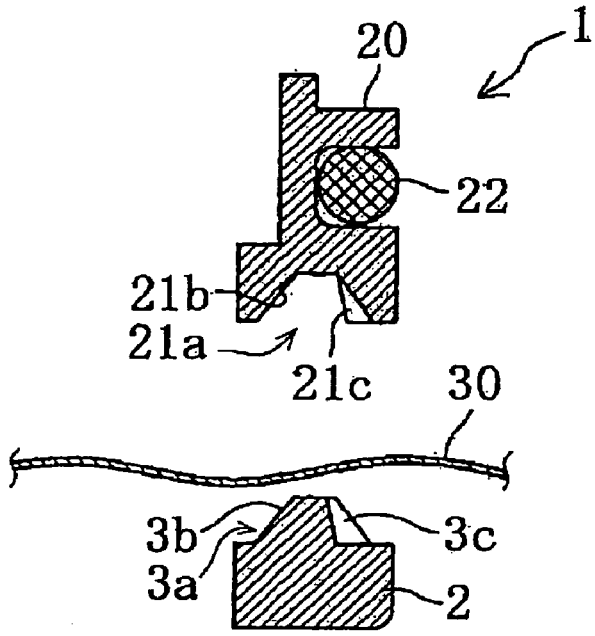
FIG. 6A shows a state before clamping a workpiece cloth between the upper frame and the lower frame.
Figure 6B:
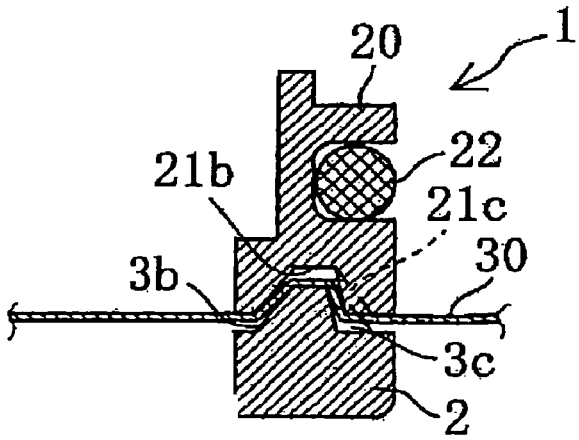
FIG. 6B shows a state wherein a workpiece cloth is clamped between a notched recess of the lower frame and a protrusion of the upper frame.
Figure 6C:
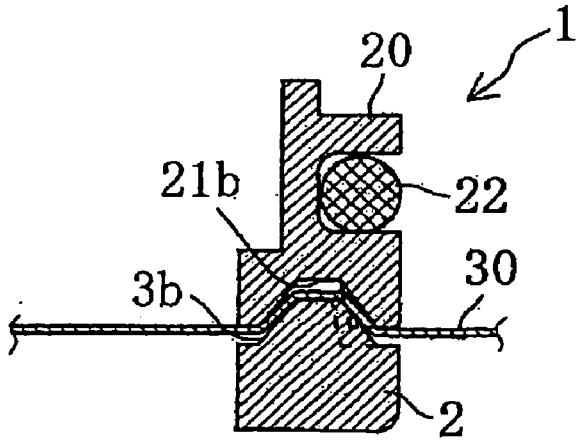
FIG. 6C shows a state wherein a workpiece cloth is clamped by sloped surfaces of an outer peripheral side of the upper frame and the lower frame.

As shown in FIGS. 2 and 3, in order to upwardly open the upper frame 20, the clamp mechanism 8 is switched to a retracted position where the cam member 9 and the support body 10 are inclined in the forward direction. Then, after the upper frame 20 is closed, as shown in FIGS. 4 and 5, the clamp mechanism 8 is switched to an active position in which the cam member 9 and the support body 10 are placed upright. As a result, the lower end of the cam surface of the cam main body 9*c* contacts the upper surface of the fore-end of the clamped portion 22*b*. Thus, the clamp mechanism 8 is arranged to be switchable between the active position and the retracted position.

The operation and effect of the embroidery frame 1 having the above construction will be described hereinafter.

First, the embroidery frame 1 is placed on the table with the upper frame 20 opened. Next, the workpiece cloth 30 to be embroidered is placed on the lower frame 2 in the proper location (refer to FIG. 6A). Then, the upper frame 20 is closed, and the workpiece cloth 30 is clamped between the groove 21*b* of the upper frame 20 and the projection 3*b* of the lower frame 2. Next, the clamp mechanism 8 is switched from the retracted position to the active position and the upper surface of the fore-end of the clamped portion 22*b* is contacted to the lower end of the cam surface of the cam main body 9*c*. Then, the operating portion 9*b* of the cam member 9 is rotated in the direction indicated by the arrow A in FIG. 1. Thus, the fore-end of the clamped portion 22*b* is downwardly pressed by the cam surface into a clamped state in which the workpiece cloth 30 is clamped by the upper and lower frames 20 and 2 (refer to FIG. 6B and 6C).

At this time, because of the multiple angular portions (corners) formed by the provision of the groove 21*b*, the protrusion 21*c*, the projection 3*b* and the notched recess 3*c* in the cloth clamping surfaces 21*a* and 3*a* of the upper and lower frames 2 and 20, the portion of the workpiece cloth 30 located [in] between the cloth clamping surfaces 21*a* and 3*a* becomes less prone to displacement.

Thus, a projection 3*b* having a substantially trapezoid cross section is formed on the cloth clamping surface 3*a* of the lower frame 2 and a plurality of notched recess 3*c* is formed on the sloped surface of the outer peripheral side of the projection 3*b*. Also, a groove 21*b* capable of being fitted with the projection 3*b* of the lower frame is formed on the cloth clamping surface 21*a* of the upper frame 20 and a plurality of protrusions 21*c* capable of being fitted with the notched recess 3*c* of the lower frame 2 are formed on the sloped surface of the outer peripheral side of the inner surface of the groove 21*b*.

Therefore, the areas of a cloth clamping surfaces 3*a* and 21*a* of the lower and upper frames 2 and 20 are increased and the frictional force between the cloth clamping surfaces 3*a* and 21*a* and the portion of the work piece cloth clamped therebetween is increased. Hence, the retainability of the cloth clamping surfaces 21*a* and 3*a* is increased.

Also, since the notched recess 3*c* and the protrusion 21*c* are formed on the cloth clamping surfaces 3*a* and 21*a* of the lower and upper frames 2 and 20, the areas of the cloth clamping surfaces 3*a* and 21*a*, especially in the outer periphery portion of the lower and upper frames 2 and 20 are increased. Thus, the portion of the workpiece cloth 30 clamped between the cloth clamping surfaces 3*a* and 21*a* can be restrained from being pulled inward with respect to the cloth clamping surfaces 3*a* and 21*a*, thereby preventing the loosening of the embroidery forming portion of the workpiece cloth 30.

Furthermore, since the peripheral length of the outer periphery of the cloth clamping surfaces 3*a* and 21*a* are increased, the shrinking of the workpiece cloth 30 is absorbed by being clamped between the cloth clamping surfaces 3*a* and 21*a* , rendering the workpiece cloth 30 less prone to creasing.

Moreover, since the cloth clamping surfaces 3*a* and 21*a* of the lower and upper frames 2 and 20 can be precisely fitted, without displacement of the fitting position, by the notched recess 3*c* and the protrusion 21*c*, the operation of clamping the workpiece cloth 30 by the lower and upper frames 2 and 20 is simplified.

Also, in the present embodiment, the projection 3*b* is provided on the cloth clamping surface 3*a* of the lower frame 2. Such provision of the projection 3*b* increases the thickness of the lower frame 2, thereby increasing the rigidity of the lower frame 2. Thus, the lower frame 2 bearing larger burden than the upper frame 20 during the sewing process can be prevented from being damaged.

The present invention is not limited to the above embodiment but can be transformed as follows.

Figure 7:
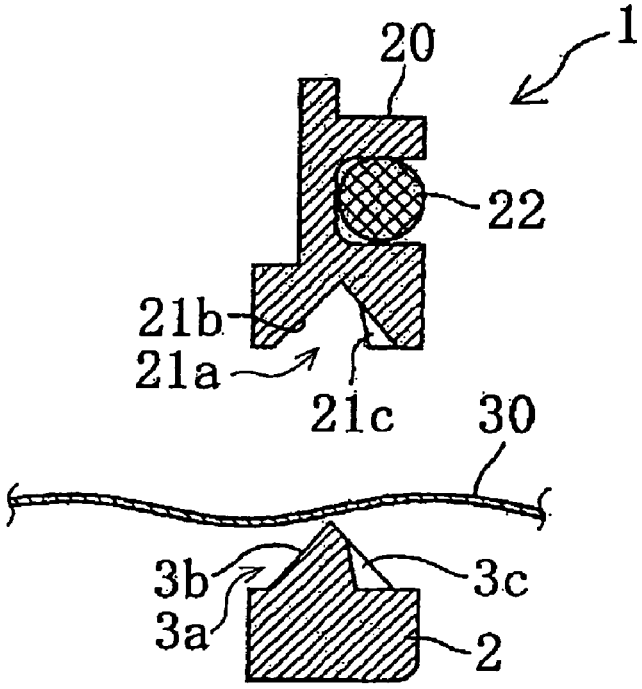
FIG. 7 corresponds to FIG. 6A showing a first transformed aspect of the disclosure.
Figure 8:
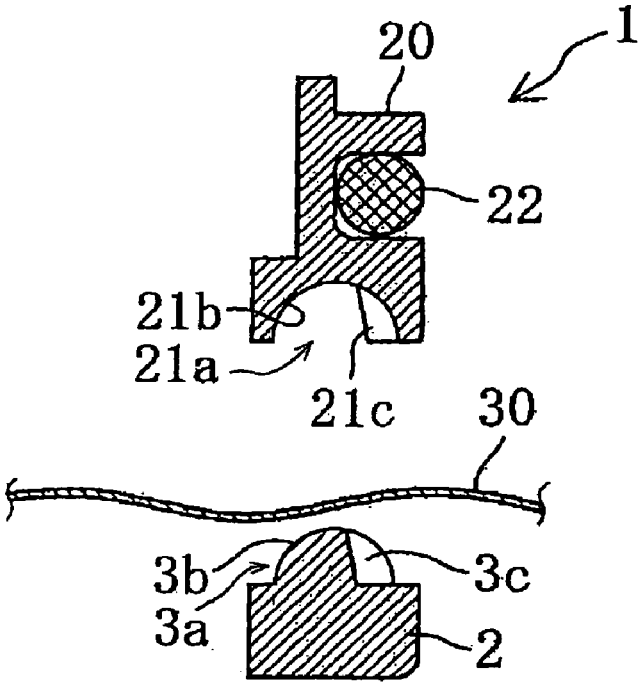
FIG. 8 corresponds to FIG. 6A showing a second transformed aspect of the disclosure.

As shown in FIG. 7, the cloth clamping surfaces 3*a* and 21*a* of the lower and upper frames 2 and 20 may be formed as triangular cross section. Also, as shown in FIG. 8, the cloth clamping surfaces 3*a* and 21*a* of the lower and upper frames 2 and 20 may be formed as semi-circle cross sections. In either case, the area of the cloth clamping surfaces 3*a* and 21*a* are increased.

The groove may be formed on the entire periphery of the cloth clamping surface 3*a* of the lower frame and the projection may be provided on the entire periphery of the cloth clamping surface 21*a* of the upper frame 20.

The notched recess 3*c* and the protrusion 21*c* may be formed on a part of the cloth clamping surfaces 3*a* and 21*a* of the lower and upper frames 2 and 20. Also, the notched recess 3*c* and the protrusion 21*c* may be formed on the entire periphery of the cloth clamping surfaces 3*a* and 21*a* in a consecutive manner (without intervals).

The upper and lower frames may be connected by 2 or more clamp units.

The shape of the embroidery frame 1 is not limited to the annular form but can be of an oval form, a rectangular form, or the like.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

I claim:

1. An embroidery frame comprising:

an upper frame;

a lower frame, the upper and lower frame clamping a workpiece cloth between an upper surface of the lower frame and a lower surface of the upper frame;

a clamping unit that presses the upper frame against the lower frame;

a projection formed on either one of the upper surface of the lower frame and the lower surface of the upper frame;

a plurality of notched recesses formed on an outer peripheral surface of the projection;

a groove formed on the other of the upper surface of the lower frame and the lower surface of the upper frame to receive the projection; and a plurality of protrusions formed in the groove that conform with the notched recesses, wherein the notched recesses increase a surface area of the projection constituting a part of a cloth clamping surface and the protrusions increase a surface area of the groove constituting a part of the cloth clamping surface.

2. The embroidery frame according to claim 1, wherein the projection is formed on the lower frame and the groove is formed on the upper frame.

3. The embroidery frame according to claim 1, wherein the projection and the groove respectively have a substantially trapezoid cross section.

4. The embroidery frame according to claim 1, wherein the projection is formed on entire periphery of either one of the upper frame and the lower frame and the groove is formed on entire periphery of the other.

5. The embroidery frame according to claim 1, in which the upper frame and the lower frame are respectively formed in an annular form and which is further provided with a hinge connection portion that openably connects the upper frame and the lower frame, the hinge connection portion and the clamp unit being provided in a mutually opposing portion.

6. An embroidery frame comprising:

an upper frame;

a lower frame, the upper and lower frame clamping a workpiece cloth between an upper surface of the lower frame and a lower surface of the upper frame;

a clamping unit that presses the upper frame against the lower frame;

a projection formed on the upper surface of the lower frame and having a substantially trapezoid cross section;

a plurality of notched recesses formed on entire periphery of an outer peripheral portion of the projection at predetermined intervals;

a groove having a substantially trapezoid cross section provided on the lower surface of the upper frame to receive the projection; and a plurality of protrusions formed in the groove that conform with the notched recesses, wherein the notched recesses increase a surface area of the projection constituting a part of a cloth clamping surface and the protrusions increase a surface area of the groove constituting a part of the cloth clamping surface.

* * * * *